United States Patent [19]

Schiebroek

[11] 4,269,004

[45] May 26, 1981

[54] EXPLOSION-PROOF BUILDING

[76] Inventor: Cornelis J. M. Schiebroek, Parklaan 60, Eindhoven, Netherlands

[21] Appl. No.: 932,374

[22] Filed: Aug. 9, 1978

[30] Foreign Application Priority Data

Aug. 15, 1977 [NL] Netherlands ..... 7708979

[51] Int. Cl.[3] ..... E04H 9/00

[52] U.S. Cl. ..... 52/1; 52/251

[58] Field of Search ..... 52/223 R, 223 L, 225, 52/222, 267, 269, 235, 83, 1, 240, 79.1, 251, 264, 477, 483

[56] References Cited

U.S. PATENT DOCUMENTS

| | | | |
|---|---|---|---|
| 2,724,465 | 11/1955 | Krauss et al. | 52/235 X |
| 2,769,332 | 11/1956 | Brown, Jr. | 52/225 X |
| 3,537,220 | 11/1970 | Ellis | 52/225 |
| 3,950,906 | 4/1976 | Mollinger | 52/235 |
| 3,998,016 | 12/1976 | Ting | 52/1 X |
| 4,050,204 | 9/1977 | Scott | 52/1 X |
| 4,094,108 | 6/1978 | Scott | 52/1 |
| 4,176,503 | 12/1979 | Ting | 52/1 |

FOREIGN PATENT DOCUMENTS

| | | | |
|---|---|---|---|
| 1410382 | 8/1965 | France | 52/223 R |

*Primary Examiner*—Price C. Faw, Jr.
*Assistant Examiner*—Carl D. Friedman
*Attorney, Agent, or Firm*—Irvin A. Lavine

[57] ABSTRACT

An explosion-proof building comprising an over-dimensioned skeleton, high quality steel wires extending in the spaces between the skeleton portions and secured to the skeleton portions, such as pre-stressed steel, as well as panels abutting the steel wires and filling the spaces between the skeleton portions.

8 Claims, 6 Drawing Figures

EXPLOSION-PROOF BUILDING

Figure 1:
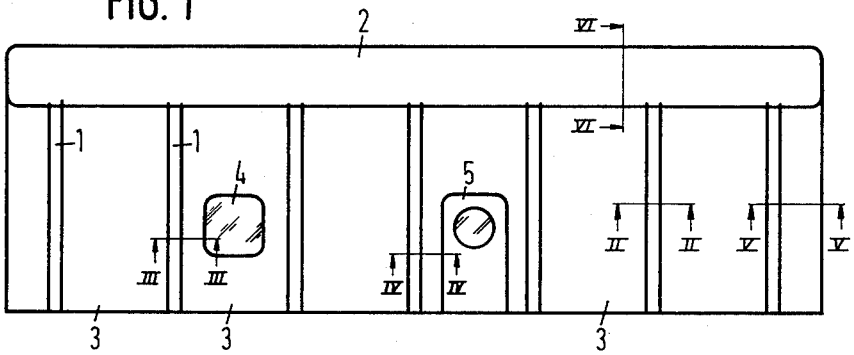

The present invention relates to an explosion-proof building, i.e. a building that does not collapse in case of an explosion outside the building. Explosion hazard exists for instance in certain chemical processes. In the immediate surroundings of the production process, however, a control and product monitoring building is often required. In the construction of such a building, however, allowance has to be made for the explosion hazard to which it is exposed. Therefore it is customary to design these buildings as a bunker. However, this is an expensive and very inconvenient construction with a depressing working atmosphere. Moreover the behaviour of such a bunker is difficultly predictable, inter alia in connection with the rather unfamiliar behaviour of the concrete and the substantial standard deviations thereof. Furthermore in case the production installation has to be renewed, changed or replaced, the concrete bunker may form a substantial obstacle which can be only with difficulty adapted or broken down.

It is the object of the present invention to provide a building lacking the above described drawbacks and yet explosion-proof, moreover allowing one to accurately predict the behaviour of the building in case of explosion.

This is achieved according to the invention if the building consists of over-dimensioned skeleton portions and of high quality, steel wires fixed on the skeleton portions, such as pre-stressed steel, as well as panels adjoining the steel wires and filling the spaces between the skeleton portions. During an explosion the building, in particular the high quality steel, will be subjected to plastic deformation, whereby use is made advantageously of the high degree in which said steel can absorb energy by plastic deformation. As an example may be mentioned FeB 1860, having an elongation of 5.8%, so that the quantity of energy to be absorbed in the plastic range is $\frac{1}{2}''$ $3{\cdot}4{\cdot}10^4$ Joule per strand. Consequently the building will be subjected during an explosion to plastic deformation, but in a quite predictable manner. The plastic deformation of the building will absorb the explosion energy by on the one hand the pulling out of square of the skeleton and on the other hand by the pressure of the panels against the pre-stressed steel wires.

Thus the invention allows construction of a comparatively lightly constructed, explosion-proof building to which can be simply imparted an aesthetical appearance and which can moreover be easily broken down or adapted to changing conditions.

A favourably distributed, regular energy absorption is obtained according to another embodiment of the present invention if both the walls and the roof are formed by prestressed steel wires extending between the skeleton portions, with adjoining wall, respectively roof panels.

Preferably the pre-stressed steel wires should extend in the spaces between the skeleton portions in uniformly spaced apart and parallel relationship. This effect can be intensified if the pre-stressed steel wires form a two-dimensional network. This construction in particular offers advantages for the roof construction whereby it is preferable that a first group of mutually parallel steel wires extend perpendicularly to a second group of mutually parallel wires.

A proper anchoring and optimal operation of the total construction is obtained if in accordance with a further embodiment of the invention, the pre-stressed steel wires secured to the skeleton portions extend through tubes disposed in the skeleton portions wherein (possibly) the wires are anchored.

In the construction of the present invention it is moreover advantageously possible that at least one panel is provided with a framework with triplex glass behind which there are disposed pre-stressed steel wires. It was found as a matter of fact that in case of an explosion the triplex glass does not splinter but will be folded around the steel wires disposed therebehind. In order to optimize said effect, it is recommended that the high quality steel wires extend through tubes. The working atmosphere is substantially improved by the thus created possibility of installing frameworks.

One embodiment of the explosion-proof building according to the present invention will now be explained, by way of example, with reference to the accompanying drawings, wherein:

FIG. 1 is a view of an explosion-proof building according to the invention; and FIGS. 2–6 are cross-sections on the lines II—II, III—III, IV—IV, V—V and VI—VI, respectively, in FIG. 1.

The building shown in FIG. 1 is provided with a foundation having a conventional reinforced concrete beamslab construction, as well as a concrete skeleton which is pre-stressed in three directions and is composed of uprights 1 and girders 2. In the spaces between two uprights 1, a girder 2 and the foundation there is disposed a wall panel 3. Frames 4 and doors 5 may be present in the wall panels.

Figure 2:
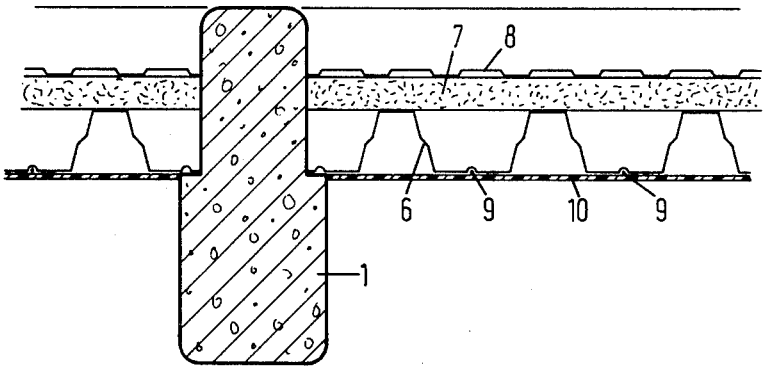

On the basis of the cross-section shown in FIG. 2, the wall construction can be elucidated. The wall panels 3 to be applied may be composed of a profiled steel plate 6, a rock wool sheet; and a profiled steel cover plate 8. The inside of steel plate 6 adjoins pre-stressed steel wires 9 which at one end are secured to the girders and on the other end to the foundation. The internal lining of the wall panels 3 may be formed by a coating 10 of vinyl on soft under-layer with fabric reinforcement.

In the following discussion of FIGS. 3–6, the parts that are also to be found in FIGS. 1 and 2 will be indicated by the same reference numerals.

Figure 3:
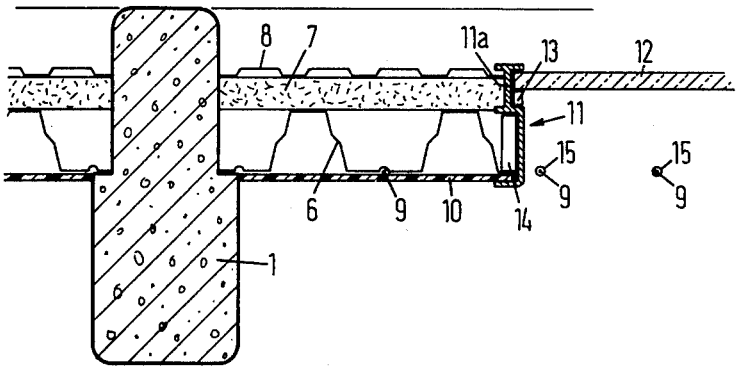

It appears from the cross-section shown in FIG. 3 how a frame 4 can be disposed in a wall panel 3. In an opening in the wall panel 3 there is installed a door-case 11, a part 11*a* of which having an I-shape. The one side of the space formed by the web and the legs of the profile thereby accommodates the rock wool sheet 7 and the cover plate 8, while the other side constitutes a locating nest for a triplex glass pane 12 as well as a filler element 13. One of the legs of the portion 11*a*, together with the other part of the door-case 11, forms a U-shaped section wherein the profiled steel plate 6 and the cover 10 are taken up. A filler 14 serves to lock the steel plate 6 serves a filler 14. The tension wires 9 adjacent the pane 12 extend through tubes 15.

Figure 4:
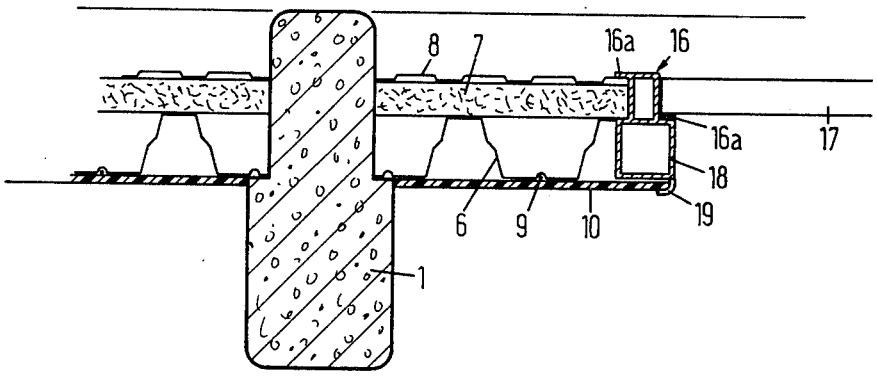

FIG. 4 shows the application of a door 5 in a wall panel 3. The opening provided therefor in the panel is framed by a door-case 16 having a depth corresponding to the thickness of the rock wool sheet 7 and the cover plate 8. The door-case 16 has a substantially box-shaped profile from which extend a pair of lips 16*a*, the one of which constituting a stop for a door body 17 and the other passing along the front of the cover plate 8. A box-shaped profile 18 having a depth equal to the profile height of the steel plate 6 furthermore is disposed between the door-case 16 and the cover layer 10, whereby the construction is completed by a curved slat member 19. It is self-evident that no prestressed steel wires 9 can be present in situ of a door.

Figure 5:
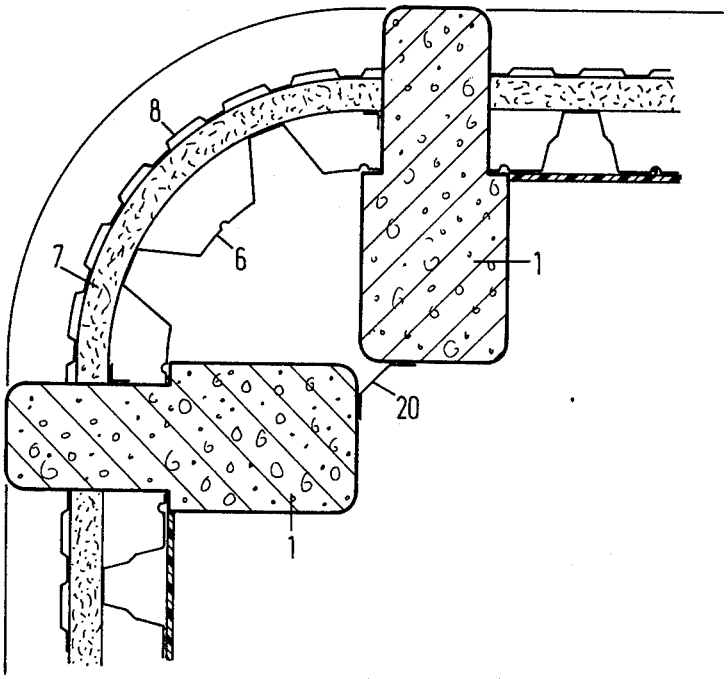

The corner construction of the explosion-proof building according to the invention may be designed as shown in FIG. 5. Two uprights are so arranged as to closely adjoin each other, but in case of explosion they can be freely pulled out of square. The employed angle-wall panel is composed of the same component as the other wall panels, consequently comprising a profiled steel plate 6, a rock wool sheet 7 and a steel cover plate 8, which however are all bent through 90°. As corner end member there is disposed a frame profile 20. In situ of such a corner construction no pre-stressed steel wires 9 need be applied.

Figure 6:
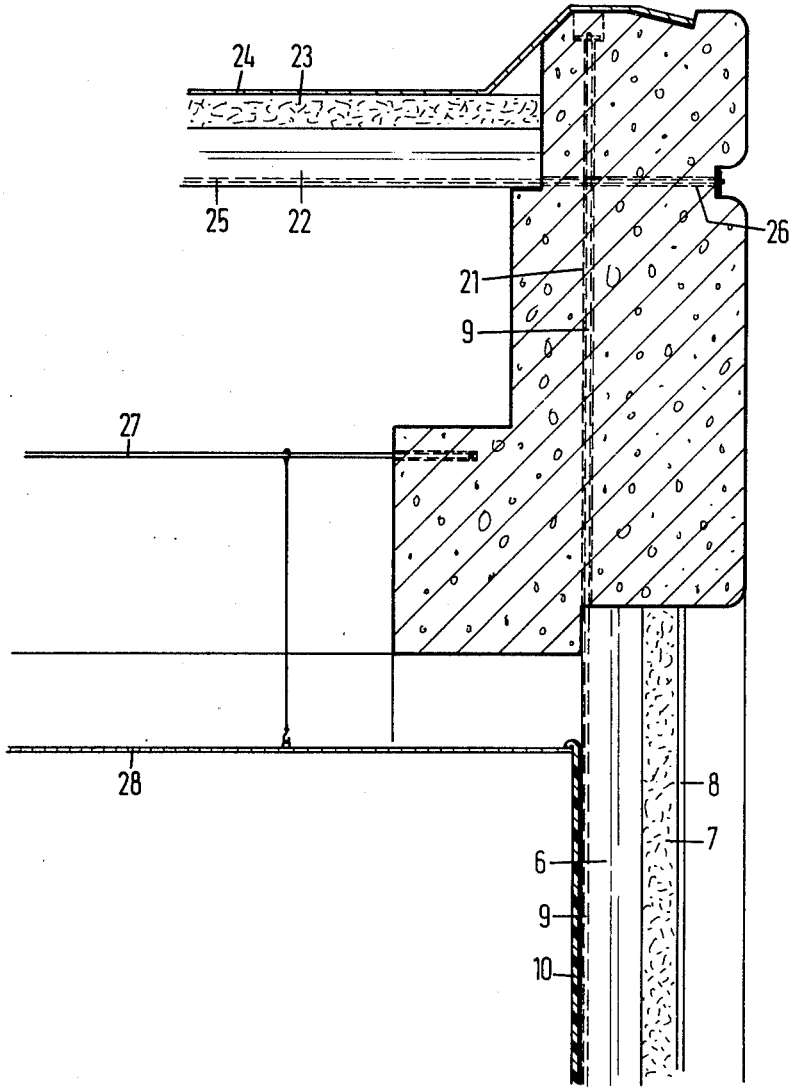

FIG. 6 shows a cross-section of a girder 2 with the contiguous wall and roof constructions. The pre-stressed steel wires 9 forming an essential part of the wall construction, extend through tubes 21 cast in the girder 2. At the top of the girder there are provisions for tensioning and/or anchoring the steel wires 9 which are anchored in the foundation.

A roof panel is composed of a profiled steel plate 22, a rock wool plate 23 and, instead of the cover plate 8 in a wall panel, a roof covering 24 of the conventional type. The steel plates 22 abut with their lower sides against pre-stressed steel wires 25 which extend through tubes 26 disposed in the girder 2, whereby at the exterior thereof there are provided means for tensioning and arresting the wires 25. It may be clear that two groups of perpendicularly crossing steel wires 25 may be disposed in a simple manner in the roof.

In the girder 2 there may be anchored yet other wires 27 from which may be suspended a lowered ceiling 28, lighting fixtures and pipes.

It stands to reason that many variants and amendments are possible within the scope of the present invention. For instance mutually crossing groups of pre-stressed steel wires may also be disposed adjacent the walls, or the wall panels may be constructed differently or may be composed of other elements.

I claim:

1. An explosion proof building comprising a wall and a roof, said wall comprising a plurality of horizontally spaced apart vertically extending structural load bearing members of concrete, and panel means in the spaces between said members, and means for plastically deforming under tension when said building is subjected to an external explosion comprising elongated elements between said load bearing members, and having the ends thereof anchored, said elongated elements being pre-stressed steel wires, said panels abutting said elements, and being on the exterior thereof.

2. An explosion proof building as in claim 1, said elongated elements being vertically extending and having their upper ends anchored to the said roof.

3. An explosion proof building as in claim 1, wherein at least some of said elements extend parallel to said structural members and in spaced relationship thereto.

4. An explosion proof building as in claim 3, and additional elements extending at an angle to said first mentioned elements.

5. An explosion proof building as in claim 1, and tubes in individual surrounding relationship to at least some of said elements.

6. An explosion proof building as in claim 1, at least one said panel means having a glass pane, at least some of said elements extending adjacent thereto.

7. An explosion proof building comprising:

(a) a foundation, (b) a plurality of horizontally spaced apart vertically extending concrete load bearing members having outwardly facing shoulders, (c) horizontally extending girder means of concrete at the tops of said load bearing members, and supported thereby, (d) a roof supported by said girder means, (e) panel means each extending from and between each two adjacent load bearing members and abutting the shoulders thereof and extending substantially the full height thereof from said foundation to said girder means, and (f) means for plastically deforming under tension when said building is subjected to an external explosion comprising elongated elements between said load bearing members, the ends of said elongated elements anchored to said foundation and girder means, and (g) said panel means being outwardly of and abutting said elongated elements.

8. The explosion proof building of claim 7, each said panel means comprising a single panel.

* * * * *